US012662910B2

(12) United States Patent
Abou-Sayed et al.

(10) Patent No.: US 12,662,910 B2
(45) Date of Patent: Jun. 23, 2026

(54) DETECTING MINERALIZATION AND MONITORING GREENHOUSE GAS PLUME LOCATION IN SUBTERRANEAN FORMATIONS

(71) Applicant: Advantek Waste Management Services, LLC, Houston, TX (US)

(72) Inventors: Omar Abou-Sayed, Houston, TX (US); Amin Amirlatifi, Houston, TX (US)

(73) Assignee: Advantek Waste Management Services, LLC, Houston, TX (US)

( * ) Notice: Subject to any disclaimer, the term of this patent is extended or adjusted under 35 U.S.C. 154(b) by 0 days.

(21) Appl. No.: 18/866,359

(22) PCT Filed: May 15, 2023

(86) PCT No.: PCT/US2023/067025
§ 371 (c)(1),
(2) Date: Nov. 15, 2024

(87) PCT Pub. No.: WO2023/225487
PCT Pub. Date: Nov. 23, 2023

(65) Prior Publication Data

US 2025/0341149 A1 Nov. 6, 2025

Related U.S. Application Data

(60) Provisional application No. 63/342,145, filed on May 15, 2022.

(51) Int. Cl.
*E21B 49/00* (2006.01)
*E21B 41/00* (2006.01)
*E21B 47/04* (2012.01)
*E21B 47/06* (2012.01)
*E21B 49/08* (2006.01)

(52) U.S. Cl.
CPC ..... *E21B 41/0064* (2013.01); *E21B 47/04* (2013.01); *E21B 47/06* (2013.01); *E21B 49/087* (2013.01); *E21B 2200/20* (2020.05)

(58) Field of Classification Search
CPC ..... E21B 49/008; E21B 41/0057; E21B 41/0064; Y02C 20/40
See application file for complete search history.

(56) References Cited

U.S. PATENT DOCUMENTS 5,345,034 A * 9/1994 Corey ..... E21B 43/00 405/128.15
5,753,109 A * 5/1998 Looney ..... B09C 1/10 210/170.07
6,210,073 B1 * 4/2001 Buehlman ..... E21B 43/30 210/170.07
7,704,746 B1 4/2010 White et al.
(Continued)

OTHER PUBLICATIONS

EP Search Report 2025-13-08 for EP App. 23808496.6-1002 / 4526549 PCT/US2023/067025.
(Continued)

*Primary Examiner* — Kenneth L Thompson
(74) *Attorney, Agent, or Firm* — Peter V. Schroeder; Booth Albanesi Schroeder PLLC

(57) ABSTRACT

The disclosed methods and apparatus generally relate to disposal of detection of mineralization and monitoring of greenhouse gas plume locations in subterranean aquifers.

6 Claims, 2 Drawing Sheets

(56) References Cited

U.S. PATENT DOCUMENTS

| | | | | |
|---|---|---|---|---|
| 8,454,268 | B2 * | 6/2013 | Wilkinson | B65G 5/005 405/59 |
| 8,517,094 | B2 | 8/2013 | Sweatman | |
| 8,548,785 | B2 * | 10/2013 | Chugunov | G01V 11/00 703/2 |
| 9,523,789 | B2 * | 12/2016 | Kamal | E21B 47/09 |
| 11,946,344 | B2 * | 4/2024 | Patel | E21B 41/0064 |
| 2002/0120429 | A1 * | 8/2002 | Ortoleva | E21B 41/0064 703/2 |
| 2008/0319729 | A1 | 12/2008 | Berge et al. | |
| 2011/0066380 | A1 | 3/2011 | Hager | |
| 2011/0174507 | A1 | 7/2011 | Burnham et al. | |
| 2012/0055674 | A1 | 3/2012 | Sweatman et al. | |
| 2012/0061084 | A1 | 3/2012 | Sweatman | |
| 2025/0003313 | A1 * | 1/2025 | Jones | E21B 49/00 |

OTHER PUBLICATIONS

Temitope, Ajayi, Jul. 8, 2019 A review of CO2 storage in geological formations emphasizing modeling . . . , Petroleum Science, vol. 16, No. 5, pp. 1028-1063.

Wenliang, Zhao Jan. 1, 2012 Monitoring ground deformation on carbon sequestration reservoirs in N. America, XP093291114.

Varre Sai Aug. 22, 2015 Influence of geochemical processes on the geomechanical response of the overburden due to CO2 storage . . . , Internat'l Journal of Greenhouse Gas Control, Elsevier Amsterdam NL, vol. 42, pp. 138-156.

EP Action Rule 70(2) Sep. 2, 2025 for EP App 23808496.6-1002 / 4526549 PCT/US2023/067025.

International Search Report and Written Opinion, PCT/US2023/067025, dated Sep. 15, 2023, 9 pages.

* cited by examiner

DETECTING MINERALIZATION AND MONITORING GREENHOUSE GAS PLUME LOCATION IN SUBTERRANEAN FORMATIONS

CROSS-REFERENCE TO RELATED APPLICATIONS

This is an International Application for patent filed under the PCT and claims priority to U.S. Provisional Patent Application Ser. No. 63/342,145, filed May 15, 2022.

FIELD

The disclosed methods and apparatus generally relate to disposal of detection of mineralization and monitoring of greenhouse gas plume locations in subterranean formations.

BRIEF DESCRIPTION OF THE DRAWING

For a more complete understanding of the features and advantages of the present disclosure, reference is now made to the detailed description of the disclosure along with the accompanying figures in which corresponding numerals in the different figures refer to corresponding parts and in which.

DETAILED DESCRIPTION

Presented are systems and methods for identifying mineralization and monitoring the location of a greenhouse gas bearing plume during subterranean storage, including in brine aquifers.

Unwanted greenhouse gases (GHG), including carbon dioxide (CO2), can be injected into subterranean formations, such as brine bearing aquifers, via injection wells, for long term storage or sequestration.

The injection wells have at least one wellbore extending from the surface to the target subterranean formation. The GHG can be injected into the target formation using high-pressure pumps and the like, as is known in the art. The wellbores can be horizontal, vertical, multilateral, etc. The injection process may include fracking, multiple injections, batch injections, and the like.

While the specification refers to the injection of GHG, it is understood that the injected fluids may be GHG or GHG-bearing fluids. That is, the GHG may be mixed or altered by combination with other injectable fluids prior to injection. Further, although the specification refers to a gas plume, this is understood to mean that the plume is created by the injected fluids, whether those fluids are in gaseous or supercritical phase. In some cases, a liquid fluid can be injected but the GHG separate from other fluid components in the formation. Relative density of the lighter GHG or GHG-bearing fluid will determine the creation of the plume.

Suitable target formations are porous and permeable reservoirs with an impermeable layer or formation above the target formation to prevent movement of the injected fluid to shallower locations. The subterranean formation may be porous rock and mineral, may have in situ fluids, such as water or brine, such as in saline aquifers. The injected fluid may be liquid, gas, foam, gel or combinations thereof, and may be treated or prepared prior to injection by mixing, adding or removing fluids, adding chemicals, etc., as is known in the art. For example, the GHG may be condensed or compressed, including into a supercritical fluid, prior to injection.

Figure 1:
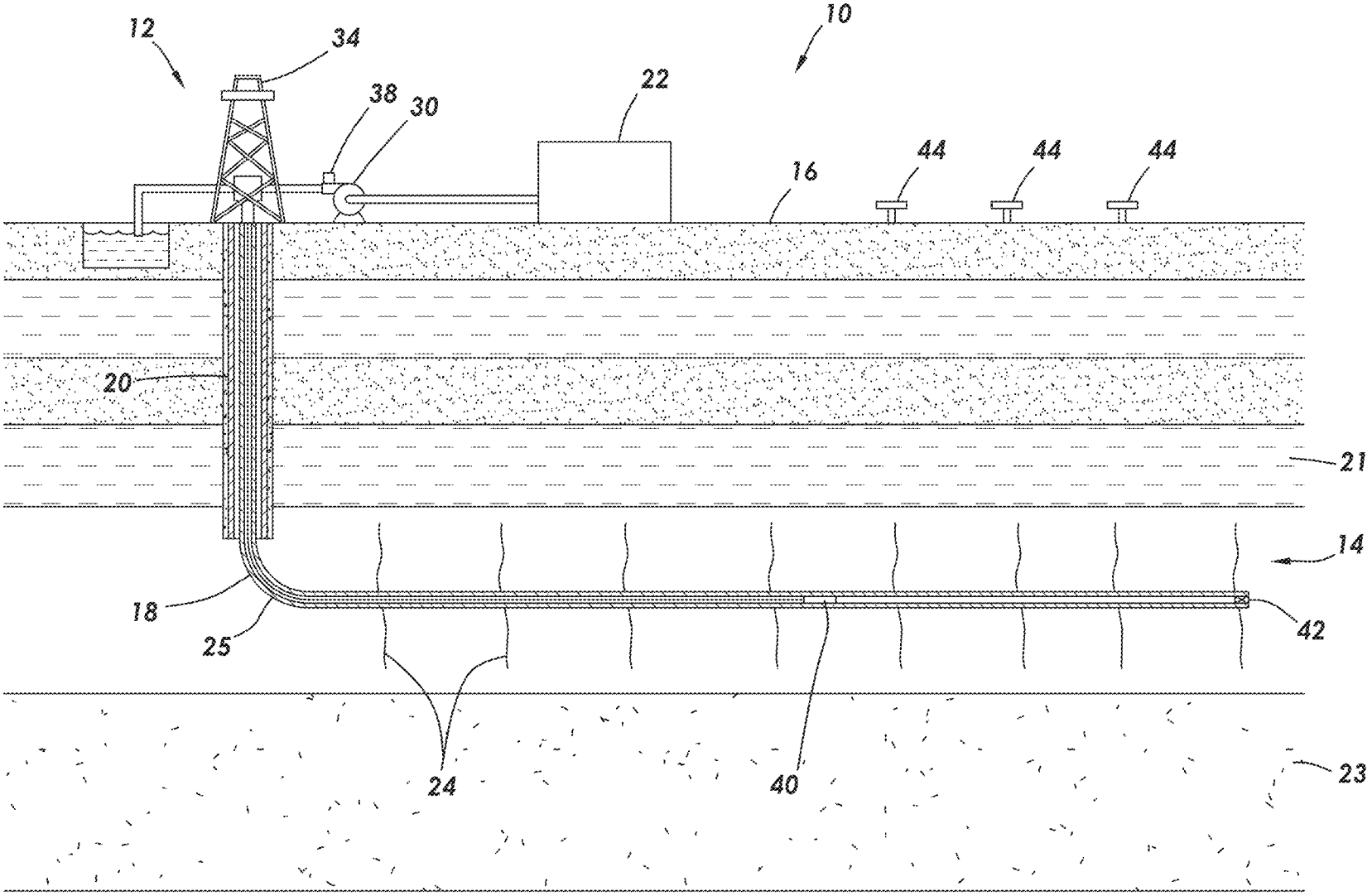
FIG. 1 is a schematic of an exemplary injection operation for injecting carbonated liquid into a subterranean formation, shown in partial cross-section, according to an aspect of the invention.

FIG. 1 is a schematic of an exemplary onshore drilling rig and wellbore, in cross-section, according to an aspect of the invention, the system generally designated 10. Rig 12 is positioned over a subterranean formation, below the earth's surface 16, having multiple layers or zones with varying geological properties. The target formation zone 14 is targeted for GHG disposal or sequestration and has corresponding properties allowing the injection, movement, and storage of fluids. A containment zone 21, above the target zone 14, conversely, has properties preventing the flow of fluids and is useful for containing carbon dioxide, and other fluids, present in the target zone 14 from migrating upwards into or past the containment zone 21. A containment zone 23 may be present below the target zone.

The rig 12 is exemplary to generally indicate surface equipment necessary for performing pumping at pressure into the target formation. Such equipment can be used for various operations, such as injection, wellbore flushing, disposal or storage, etc. The rig 12, as shown, can include a derrick 34 for supporting a hoisting apparatus for raising and lowering pipe strings, such as work strings, production strings, and casing 20. Similarly, coiled tubing and wireline operations can be run in the well. Pump 30 is capable of pumping a variety of wellbore compositions of various consistencies into the well. One or more pressure measurement devices 38 provide pressure readings, for example, at the pump discharge, wellhead, primary and annular bores, etc.

Wellbore 18 has been drilled through the various earth strata, including formation zone 14. Upon completion of drilling, a casing 20 is typically cemented in place in the wellbore 18 to facilitate the production of oil and gas from the targeted formation 14. The targeted zone 14 can be a saline aquifer as saline aquifers have properties necessary to inject, allow subterranean movement of, and store large volumes of GHG. It is understood that the aquifer can have additional fluid components present.

Casing 20 extends downhole along wellbore 18 through a selected section of the wellbore. As shown, the casing 20 extends along the vertical section of the wellbore, although casing can also be positioned along the horizontal section if desired. The casing annulus between the casing 20 and wellbore 18 contains cement to secure the casing 20 in place and prevent leakage upwards on the outside of the casing. If casing is used along the target zone, the casing can be pre-perforated or perforated in place using typical perforation techniques. More often, a liner 25 is positioned in the wellbore, extending or hung from the casing. The liner 25, at the target zone, is pre-perforated, slotted, or perforated at its downhole location. The perforations provide fluid communication between the target zone 14 and the wellbore 18 interior to the casing or liner. Alternately, the wellbore at the target zone can be open hole. A tubing annulus is formed between the casing or liner and any work string positioned therein. An exemplary downhole tool assembly 40 is shown in the wellbore 18 and can be one or more downhole tools, connected or disconnected, on a wireline, workstring, or other conveyance, or permanently installed in the wellbore. For example, the tool assembly 40 can include an array of sensors for data acquisition and transmission.

In some embodiments, the methods are used with respect to a target zone which has been previously hydraulically fractured, creating exemplary cracks 24. The fractures can intersect one another, creating a connected fracture network. In some cases, multiple sections of the target zone are injected, sometimes sequentially, and can be fluidly isolated from one another to allow, in conjunction with isolation or barrier devices, downhole valves, and the like, control of fluid communication with each section of the zone. In some embodiments, the GHG or GHG-bearing fluid is injected at above fracture gradient.

During GHG injection operations, GHG, stored and treated in surface tanks 22 or the like, is pumped downhole by a pump 30 under pressure. The GHG at the surface, and not under artificial pressure, is in a gaseous phase. For injection, the GHG can be placed under pressure utilizing pumps, compressors and the like, to supercritical phase. In some embodiments, the GHG is compressed to supercritical phase, then pumped downhole, through the vertical section of the wellbore, through the horizontal section of the wellbore (if present) and into the target zone. Although it is anticipated that the method will not require injection at above fracture pressure, causing resulting fractures in the target formation, in some embodiments injection can be above fracture pressure.

The injected GHG, or GHG-bearing fluid, will float to the top of the formation as it is of less density than the fluid in situ in the formation. The GHG injected in a saline aquifer at depths greater than 3,000 ft will be in a supercritical phase due to the thermodynamic nature of the subsurface formation. It is less viscous and less dense than the formation brine and thus due to gravity segregation, it navigates upwards following a permeable pathway to settle on top of the brine. Due to the pressure and temperature conditions of the subsurface formation, injected GHG can remain in supercritical phase with lower viscosity and density compared to the formation brine, which enables the upward movement of GHG due to gravity segregation to be trapped on top of the brine and below the non-permeable containment zone.

Saline aquifers are the porous and permeable geological formations containing saline water within pore spaces and are identified as a target for GHG injection. The injected GHG tends to be buoyant in any in situ formation fluids, exerting upward pressure on the formations above the target or storage formation. The injected GHG creates a "plume" within the subterranean formation. This plume may "travel" from the injection site, that is, change location over time.

Figure 2A:
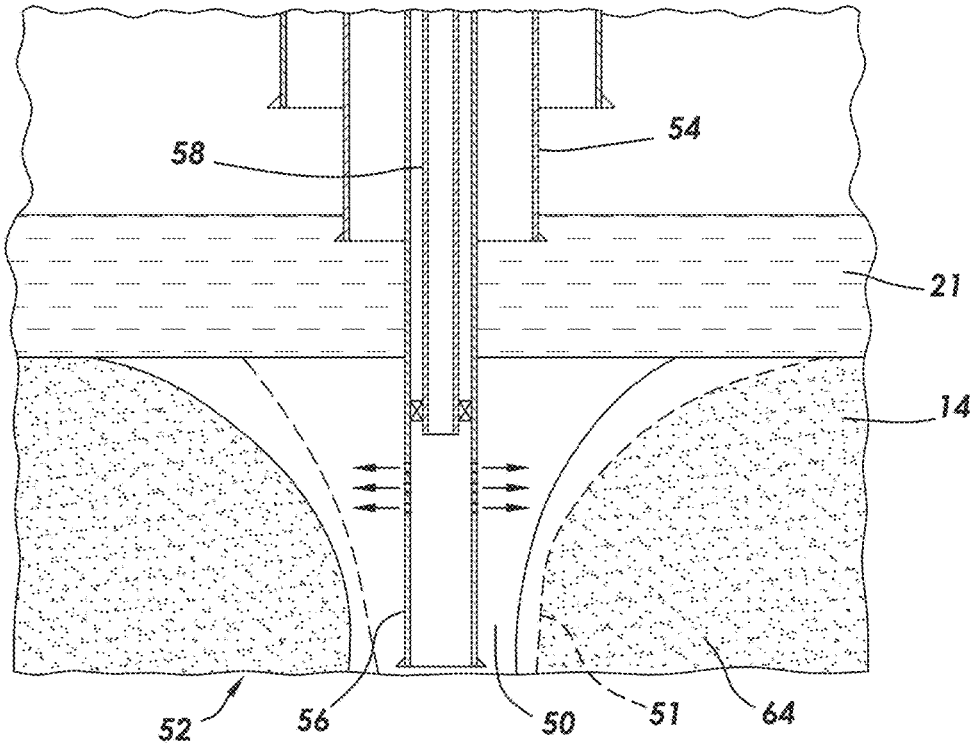
FIGS. 2A-B are schematics in elevation showing exemplary plumes and movement thereof in a vertical and horizontal injection well.
Figure 2B:
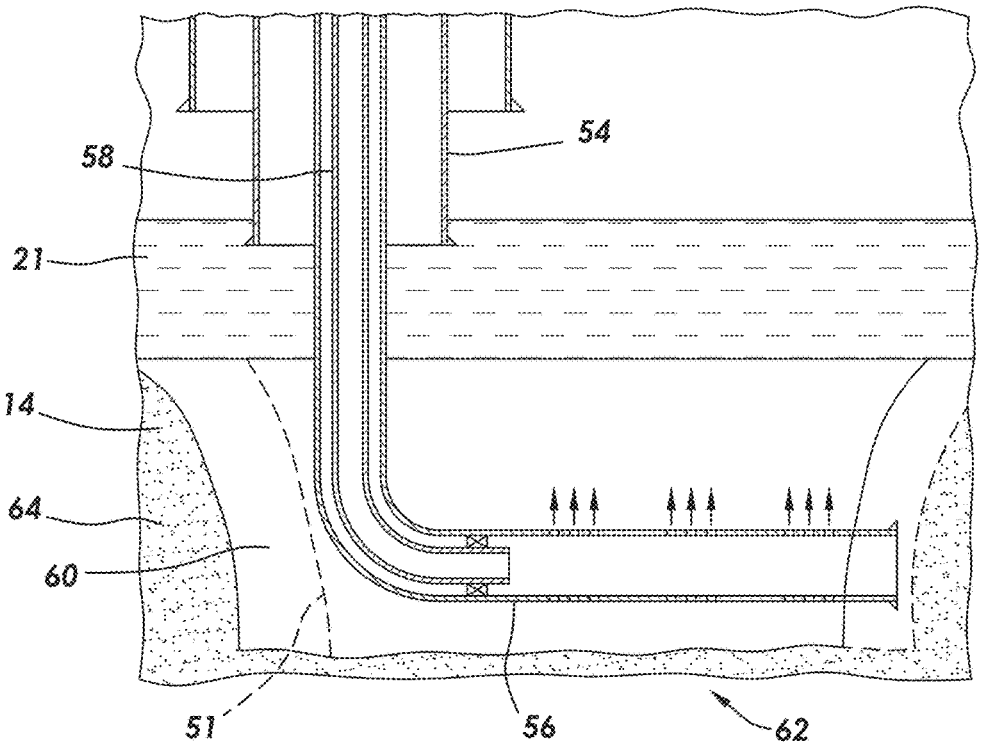

FIGS. 2A-B are comparative schematics showing exemplary GHG plumes in a vertical injection well and a horizontal injection well. FIG. 2A shows a plume 50 for a vertical well 52. FIG. 2B shows a plume 60 for a horizontal well 62. The wells are shown schematically having a casing 54, liner 56, and workstring 58 extending into the target zone 14 below a containment zone 21. Outside the plumes are areas of the zone containing brine 64. Movement of the GHG plume to a new location is indicated by the dashed lines and as indicated by modified plumes 51. The shape of the GHG plume around the wellbore depends on the interplay of viscosity, gravity, and capillary forces between the formation fluid and GHG. Generally, the plume will take on an inverted cone shape as it spreads into the aquifer and beneath a scaling cap rock.

Geochemical reactions between the injected GHG and the formation rock and fluids can result in mineral depositions that can clog microscopic pores in the rock. This, in turn, lowers available pore space for injected fluid and may result in pressure buildup in the formation, especially in the vicinity of the injection wellbore. It is desirable to detect mineralization in the formation and to detect and locate any plume created by the injected GHG, especially should the plume move locations.

In some embodiments of the disclosure, the plume and mineralization are monitored and detected by a combination of underground and surface sensors, satellite monitoring, numerical modeling, computer modeling, and superposition or trend analyses.

In some embodiments, a system comprises of a numerical or computerized model of the geologic formation, pressure sensors mounted at the bottom of the injection wellbore, surface mounted reflective mirrors oriented towards orbiting remote sensing satellites, and program codes to monitor the pressure data from the sensors and estimate the location of the injected GHG plume.

The method comprises taking relevant measurements at spaced intervals over time to determine changes in relevant plume and reservoir data. For example, in some embodiments a pressure sensor 42 is positioned downhole to provide bottom hole pressure. The measurements are taken at spaced intervals and recorded. In some embodiments, pressure sensors at or near the surface are utilized to determine up hole annular or tubing pressure at selected intervals. In some embodiments, temperature sensors are employed up or downhole, as temperature changes will affect pressure.

In some embodiments, permeability of the formation is estimated at intervals using well testing techniques. For example, well testing techniques can utilize pressure measurements during injection and during fall off of pressure during fall off tests. Changes in permeability over time are related to the plugging of pore space due to the mineralization of injected GHG as well as relative permeability effects.

In some embodiments, one or more surface meters or measurement devices 44 are positioned to take selected measurements of data. For example, the surface measurement devices can include tilt meters, microseismic meters, ground impedance measuring equipment, altimeter equipment, etc. FIG. 1 simply indicates generally the use and potential spaced placement of selected equipment and is not intended to be an artistic rendition of the various types of equipment. Further, some of the equipment will include numerous devices positioned over a wide area.

In an embodiment, microseismic meters are placed and employed to measure microseismic activity allowing analysis of the formation structure and plume migration using seismic waves from subsurface stress changes and fractures.

In some embodiments, ground impedance, resistivity, or electric field measurements are taken over time. For example, ground resistivity can be measured by applying an electrical current between two electrodes implanted in the ground and measuring the difference of potential between two additional electrodes that do not carry current. An injection wellbore can be used in place of one of the current carrying electrodes. Taking such surveys at different times will enable differences that arise due to mineralization to be assessed and quantified.

In some embodiments, measurements of surface altitude, or relative altitude, are measured at selected intervals to measure the changes in altitude due to uplift forces from the plume, and settling should the plume move to another location. For example, surface altitude or relative altitude can be measured using direct leveling. Altitude can be measured using pressure altimeters or radio and other reflective wave altimeters. For example, radar interferometry, synthetic aperture radar, or interferometric synthetic aperture radar can be employed to measure earth surface altitude. Altitude measurements are taken at the same surface locations at selected intervals to track changes in the height of the earth's surface. Using measurements from multiple locations across the area of interest yields a map of the earth uplift. Using measurements from the same locations over time yields a map of earth uplift changes. In another embodiment, waves, such as radar waves, are emitted and received between surface mounted units (transmitter, receiver, reflector) and a satellite unit (transmitter, receiver, reflector) to indicate surface altitude and changes thereof. In another embodiment, tilt meters are used to indicate changes in incline of the earth's surface at selected locations over time.

The data gleaned from one or more of the sensors or systems described above can be utilized to directly measure earth uplift and changes over time. Additionally, data from some of the described systems can be used to track formation pressure and permeability over time. Other data can be employed in a computer modelled reservoir to predict the location of a plume, its position over time, and its predicted position over time. Further, some of the data, such as formation pressure and permeability can be used to measure the mineralization of the formation over time, since the mineralization will effect zonal permeability and pressure. For example, pressure data can be compared against expected pressure, as determined by a computerized model, at a given time to determine the reduction of available pore spaces for GHG injection. Computer modelling or subterranean reservoirs is known in the art, including 3-dimensional models.

Measurements allowing tracking of the plume and mineralization of the formation over time, can be input to a computerized reservoir model. The computerized model can be used to map surface and formation changes over time, predict future changes based on past data and measured and calculated formation parameters. Further, should such predictions indicate possible problems, the computer model can be used to model intervention techniques to alter predicted plume and mineralization behavior.

The computerized model and modelling is created using a computer having a non-transitory memory, a processor, and a software program executable by the computer, as is known in the art. The data from the various measurements are input to the computer for use by the program. The computer program creates a three-dimensional map of the earth's surface indicating the location of the plume and changes to its location over time. Further, the computer program can be used to create a reservoir model, using the measured data, to model a reservoir permeability and pressure, and changes in the same over time. Finally, the computer model can be used to predict the changing location of the plume and/or changes in reservoir pressure and permeability over time. The reservoir permeability and pressure can further be used to model mineralization of the plume in the subterranean reservoir.

While the foregoing written description of the disclosure enables one of ordinary skill to make and use the embodiments discussed, those of ordinary skill will understand and appreciate the existence of variations, combinations, and equivalents of the specific embodiments, methods, and examples herein. The disclosure should therefore not be limited by the above described embodiments, methods, and examples. While this disclosure has been described with reference to illustrative embodiments, this description is not intended to be construed in a limiting sense. Various modifications and combinations of the illustrative embodiments as well as other embodiments of the disclosure will be apparent to persons skilled in the art upon reference to the description. It is, therefore, intended that the appended claims encompass any such modifications or embodiments.

The particular embodiments disclosed above are illustrative only, as the present disclosure may be modified and practiced in different but equivalent manners apparent to those skilled in the art having the benefit of the teachings herein. It is, therefore, evident that the particular illustrative embodiments disclosed above may be altered or modified and all such variations are considered within the scope of the present disclosure. The various elements or steps according to the disclosed elements or steps can be combined advantageously or practiced together in various combinations or sub-combinations of elements or sequences of steps to increase the efficiency and benefits that can be obtained from the disclosure. It will be appreciated that one or more of the above embodiments may be combined with one or more of the other embodiments, unless explicitly stated otherwise. Furthermore, no limitations are intended to the details of construction, composition, design, or steps herein shown, other than as described in the claims.

It is claimed:

1. A method for measuring the location of a subterranean gas plume, the method comprising:

injecting greenhouse gas bearing fluid into a subterranean formation, the injected fluid creating a gas plume in the formation, the plume moving locations over time, the plume causing earth surface uplift;

performing a series of measurements at spaced intervals of time to determine the changes in earth surface altitude or relative altitude at selected locations, the measurements providing measured data;

using the measured data to determine a first plume location at a selected first time;

using the measured data to determine a second plume location at a selected second time;

performing a series of measurements at spaced intervals of time to determine the changes in the subterranean pressure or permeability, the measurements yielding pressure or permeability data; and using the measured pressure or permeability data to determine a mineralization of the subterranean plume at a selected first time; and using the measured pressure or permeability data to determine the mineralization of the subterranean plume at a selected second time.

2. The method of claim 1, further comprising taking direct leveling measurements to determine earth surface altitude or relative altitude.

3. The method of claim 1, further comprising taking radar interferometry, synthetic aperture radar, or interferometric synthetic aperture radar measurements to determine altitude or relative altitude.

4. The method of claim 1, further comprising transmitting and receiving electronic waves between surface mounted units and a satellite unit to indicate surface altitude or relative altitude.

5. The method of claim 1, further comprising measuring the tilt of the earth surface using a plurality of tilt meters positioned at spaced locations.

6. A method for measuring the location of a subterranean gas plume, the method comprising:

injecting greenhouse gas bearing fluid into a subterranean formation, the injected fluid creating a gas plume in the formation, the plume moving locations over time, the plume causing earth surface uplift;

performing a series of measurements at spaced intervals of time to determine the changes in earth surface altitude or relative altitude at selected locations, the measurements providing measured data;

inputting the measured data into a computer having a non-transitory memory, a processor, and a software program executable by the computer, simulating, using the program, a subterranean reservoir and a simulated earth surface, including altitude or relative altitude at a plurality of locations on the simulated earth surface, based on the measured data taken at a first time;

simulating, using the program, a subterranean reservoir and a simulated earth surface, including altitude or relative altitude at a plurality of locations on the simulated earth surface, based on the measured data taken at a second time;

simulating, using the program, changes to the subterranean reservoir and the simulated earth surface based on the measured data;

predicting, using the computer, the altitude or relative altitude at a plurality of locations on the simulated earth surface based on the measured data; and simulating mineralization of the plume, using the computer, based on the measured data.

* * * * *